US005715553A

United States Patent [19]

Baron et al.

[11] Patent Number: 5,715,553

[45] Date of Patent: Feb. 10, 1998

[54] BED SKIRT

[76] Inventors: David Baron; Adam Levinsohn, both c/o Levinsohn Textile Co., Inc., 358 Fifth Ave., New York, N.Y. 10001

[21] Appl. No.: 618,347

[22] Filed: Mar. 19, 1996

[51] Int. Cl.[6] ..... A47G 9/02

[52] U.S. Cl. ..... 5/493; 5/923; 5/663

[58] Field of Search ..... 5/663, 482, 493, 5/923

[56] References Cited

U.S. PATENT DOCUMENTS

| | | | |
|---|---|---|---|
| 2,763,875 | 9/1956 | Piontkowski | 5/493 |
| 3,066,321 | 12/1962 | Kintner | 5/923 X |
| 5,086,531 | 2/1992 | Carlos | 5/493 |
| 5,335,383 | 8/1994 | Schwind | 5/493 |
| 5,353,456 | 10/1994 | Evans | 5/493 |

*Primary Examiner*—Michael F. Trettel
*Attorney, Agent, or Firm*—Robert W. Fiddler

[57] ABSTRACT

A bed skirt for use over the lower part of a bed having a foot and opposed spaced sides and a horizontally extending mattress supported on a bedstead formed by a frame and legs, said bed skirt extending over the legs of the bed to provide a desired enclosure for the lower portion of the bed to minimize dust accumulations under the bed and to provide a decorative enclosure for the lower part of the bed. The bed skirt is formed with a vertically extending skirt portion or flounce dimensioned to extend along at least the foot and opposed sides of the bed from a point close to the floor to a point above the legs of the bed. Secured to the top edge of the skirt by a single continuous line of stitching is a retaining strip which extends horizontally from the upper edge of the skirt portion over at least a part of the bed frame, preferably a distance such as to cover the edge of the horizontal surface of the mattress support. A plurality of spaced complementary fastening elements of a hook and loop type of fastening element are secured to the retaining strip therealong and a plurality of mating complementary fastening elements of said hook and loop type of fastening elements are provided adhesively securable to a horizontal surface of the bed frame, preferably the mattress support, at points such that the spacing of said fastening elements on the horizontal surface of the bed frame matches the spacing of the hook and loop elements secured to said retaining element, whereby said retaining element and its associated skirt portion may be selectively positioned along the side and bottom edges of the bed and held in this pre-selected position.

9 Claims, 1 Drawing Sheet

BED SKIRT

This invention relates to the art of bed skirts, namely bed coverings employed to cover the lower portions of a bed to minimize the flow of dust laden air under the bed and to provide a decorative appearance for the bed.

BACKGROUND OF THE INVENTION

The bed skirt herein disclosed is an improvement of applicants' fathers' prior invention as short in U.S. Pat. No. 4,141,097 in which a bed skirt referred to as a dust ruffle is disclosed in which the vertically extending skirt or flounce surrounding the lower part of the bed is secured to a horizontally extending sheet member overlying a horizontal portion of the bed, typically the portion of the bed supporting the mattress which is conventionally a box spring, but may also be formed of a platform where box springs are not being used.

As set forth in this prior patent, problems arise in maintaining the bed skirt or dust ruffle in position due to movement of the bedding as a result of normal movement of a sleeper using the bed. Further as in the production of any product, it would be desirable to minimize the quantities of material employed in forming the product, and minimize the steps involved in producing the product.

Another problem arising in the use of previously developed bed skirts is that in forming these earlier known bed skirts, the bed skirt is maintained in desired position by means of a horizontally extending retaining surface connected to the upper edge of the vertically extending skirt structure. The conventional retaining structure is formed by what is referred to as a "platform" which is a horizontally extending sheet positioned between the box spring and mattress. This conventional platform increases the cost of production, packaging, handling and shipping of the conventional dust ruffle due to its bulk. Where, as in the above referred to patent, the conventional platform may be formed by edge strips overlying the edges of the mattress supporting box spring or platform, retention of the bed skirt with respect to the mattress often presents problems of positioning the bed skirt with respect to the bed and maintenance of the desired orientation of the bed skirt with respect to the bed when in use.

Further problems have arisen in the past, where, in an attempt to minimize production costs, a relatively inexpensive, usually white or greige goods fabric, has been employed in forming the retaining platform. Where a platform formed of inexpensive white or greige goods fabric is employed, conventional shifting of the bed skirt arising during movement of a sleeper on the bed often exposes the platform to view, producing what is regarded as an unsightly result.

SUMMARY OF THE INVENTION

It is with the above considerations in mind that the present improved construction has been evolved, providing an improved bed skirt which may be securely anchored in position with respect to a bed, which requires relatively little fabric, prevents exposure of any unsightly retaining portions, can be positioned without removing the mattress from the bed and employs components which may be assembled with minimum handling at relatively low cost.

It is accordingly among the primary objects of the invention to provide an improved bed skirt which may be assembled at minimum cost.

Another object of the invention is to provide a bed skiff which may be supported with respect to a bedstead with minimal slippage of the skin with respect to the mattress support such as a box spring over which such bed skirts are generally applied such as often occurs where conventional bed skirts are employed due to shifting of bedding as the bed is used.

Another important object of the invention is to provide an effective and inexpensive way of securing a bed skirt with respect to a mattress support such as a box spring or bed platform.

It is also an object of the invention to minimize the expense of producing, packaging, storing and shipping the bed skirt.

A further important object of the invention is to eliminate unsightly exposure of the bed skirt retaining elements when the bed skirt is installed.

These and other objects of the invention which will become hereafter apparent are achieved by forming a bed skirt for use to cover the mattress supporting part of the lower part of a bed having a horizontally extending mattress supported on a bedstead formed by a frame and leg structure with a box spring or platform supporting the mattress. The bed skirt is formed with a vertically extending skirt or flounce dimensioned to extend along at least the foot and opposed sides of the bed from a point close to the floor to a point above the legs of the bed to the top of the box spring, platform or other mattress support being employed. A retaining element, preferably of the same or a decoratively compatible material as that of the skirt, is secured to the top edge of the skirt and extends horizontally from the upper edge of the skirt over at least a part of the mattress support of the bed frame, preferably a distance such as to cover the edge of the horizontal surface of the mattresssupporting element of the bed such as a box spring or platform. A fastening strip formed preferably by a strip of complementary fastening elements of a hook and loop type of fastening element is secured to the retaining element therealong and a strip of mating complementary fastening elements of hook and loop type of fastening elements is provided adhesively securable to a horizontal surface of the bed, preferably the mattress supporting box spring or platform to engage the hook and loop elements secured to said retaining element, whereby said retaining element and its associated skirt may be selectively positioned and fastened along the side and bottom edges of the bed and held in this pre-selected position.

In use, the bed skirt formed as above described, is secured in desired position with respect to a bed by first positioning the adhesive backed hook and loop strip on the top of the horizontal surface of the mattress support such as a box spring or platform to which it is adhesively secured. The retaining strip on the bed skirt is then positioned so that the mating hook and loop strip on the retaining element can be pressed into engagement with the hook and loop strip adhesively secured to the edge of the top of the mattress support to engage same and fasten the bed skirt in desired position.

A feature of the invention resides in the fact that the components of the bed skirt, namely the skirt portion, retaining strip and fastening strip may be assembled in a single pass through a sewing machine thus minimizing production costs.

Another feature of the invention resides in the formation of the retaining member of the bed skirt in the form of a continuous strip of fabric secured to the top edge of the skirt forming the bed skin, so that material requirements are minimized and it becomes economically feasible to employ a fabric for the retaining element which is decoratively compatible with that of the skirt of the bed skirt so that exposure of the retaining element will not produce an unsightly appearance.

It is also a feature of the invention that by employing hook and loop fasteners of the type commonly identified under the trademark VELCRO, secure attachment of the bed skirt with respect to the bed frame may be attained.

An additional feature of the invention resides in the fact that by employing hook and loop securable retaining strips to maintain the skirt in position, the quantity of material employed in forming the bed skirt is substantially reduced as a result of which packaging, storage and shipping costs are substantially reduced.

BRIEF DESCRIPTION OF THE DRAWINGS

The specific details of the invention and their mode of functioning will be described in clear concise and exact terms setting forth the best mode contemplated for practicing the invention so as to enable any person skilled in the art to practice the invention, in conjunction with the accompanying drawing wherein.

DETAILED DESCRIPTION OF A PREFERRED EMBODIMENT OF THE INVENTION

Figure 1:
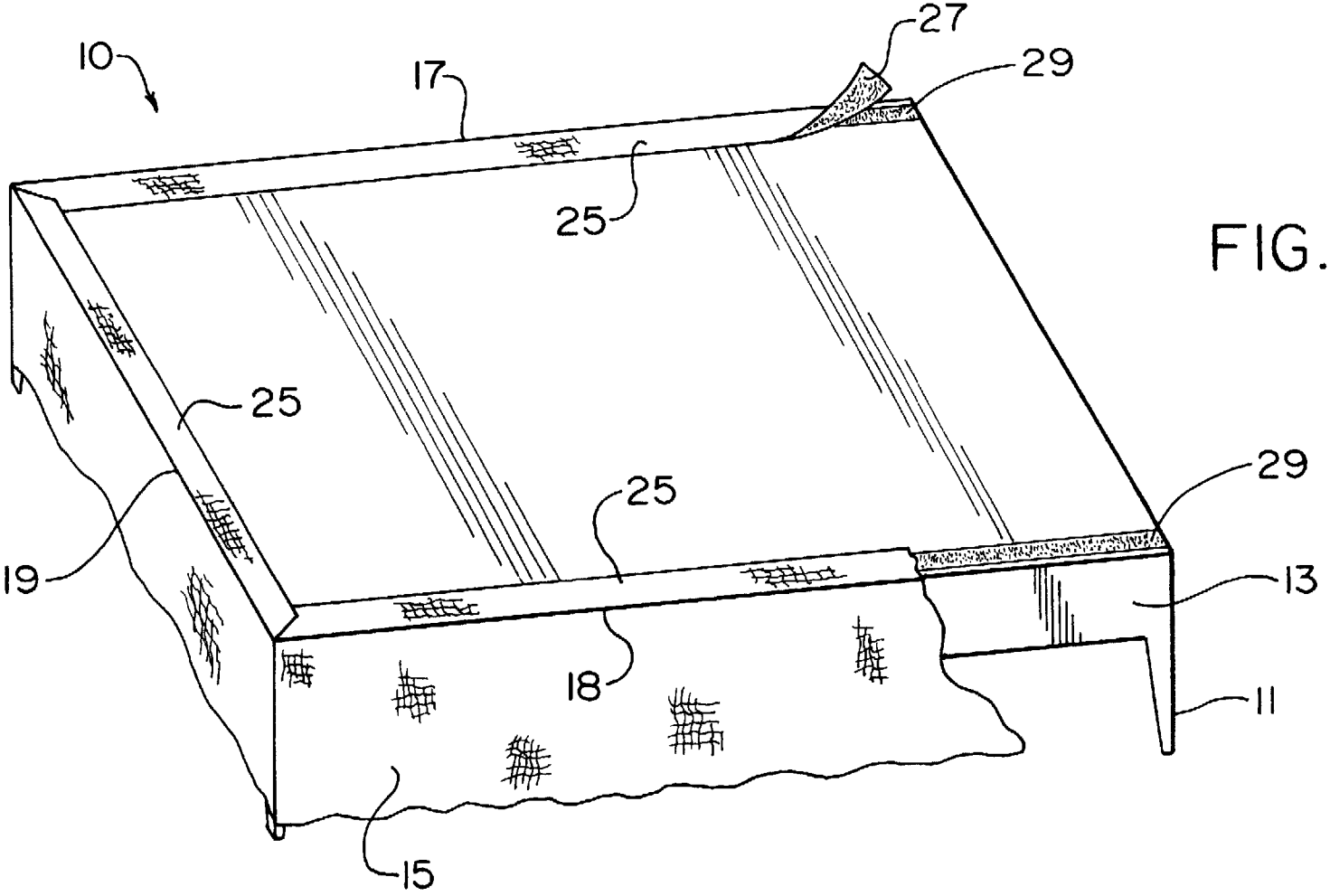
FIG. 1 is a perspective view of a preferred form of the bed skirt shown in position on a box spring in position on a bedstead with an end of the retaining strip folded back to show the hook and loop fastening strip and with parts broken away on the bed skirt to show the mating hook and loop fastening strips in position on the top horizontal surface of the mattress support, illustratively shown as a box spring, to which mating hook and loop fastening elements are secured.

Referring now more particularly to the drawing, the bed skirt 10, is illustratively shown as used on a bedstead having legs 11 and a mattress support 13, illustratively shown as box spring. Bed skirt 10 is formed with a vertically extending skirt portion 15 dimensioned to extend from the top of the box spring forming the mattress support 13 down over legs 11 to a point just above the floor. Where a box spring is not employed, and a mattress support such as a platform is employed the skirt will extend from the top of the platform down over bed legs 11 to a point just above the floor. The skirt portion 15 of bed skirt 10 is preferably of a length to extend over the opposed sides 17 and 18 and foot 19 of the bed as illustratively shown. The retaining element or strip 25 is preferably formed by a continuous strip of material secured by sewing to the top edge of the vertically extending skirt portion 15. In a typical installation a retaining strip width of between one half inch and twenty inches may be employed depending on the width of the bed, with a strip of a three inch width being preferred.

A fastening strip 27 of hook and loop fasteners such as VELCRO hook and loop fasteners is secured to the retaining strip 25 along its length. Fastening strips 27 of hook and loop fasteners of a width of between one half inch and six inches may be satisfactorily employed, with the fastening strip 27 having a width something less than the width of the retaining strip 25 to which it is secured. The hook and loop fastening strip 27 may be secured to retaining strip 25 either by sewing or adhesively in which case it is preferred to employ an adhesive backed hook and loop fastening strip 27. A VELCRO hook and loop fastening strip of one half inch is found to provide desirable results on a three inch wide retaining strip. A mating hook and loop fastener strip 29 is provided for adhesive securement to the top of the mattress support 13, it being preferred to employ the hook elements in forming the fastener strip 29 attached to the mattress support 13 as seen to the lower right in the drawing. Fastener strip 29 is of a length equal to that of fastener strip 27 and preferably of a corresponding width.

The skirt 15 is preferably stitched in a continuous line of stitching to the edges of the retaining element strip 25. The hook and loop retaining strip 27 is sewn or preferably adhesively secured to the retaining strip 25, preferably at the free edge thereof remote from the skirt portion.

The above described bed skirt 10 is preferably produced from sheet materials, usually textile fabrics, or any other desired sheet materials having desired texture and appearance such as deemed desirable for use in the formation of bed skirts. Conventional textile or other sheet material fabrication and assembly techniques are employed in forming the desired bed skirt 10. It is preferred that the skirt portion 15 and retaining strip 27 be formed of the same material or materials of esthetically compatible textures and colors and sewn together in a single pass through a sewing machine.

OPERATION

In use, the above described dust ruffle 10 after production and assembly as above described is applied to a bed by adhesively securing the fastening strip 29 of the loop forming fastening elements of a hook and loop pair of fastening elements to the mattress support such as box spring 13 along the top edge thereof along the sides 17, 18 and foot 19 of the bed preferably arranged inward of the edge of the top surface of mattress support 13 a distance such as to underlie the free edge of the retaining strip 25 of the bed skin 10, which with a preferred arrangement employing a three inch wide retaining strip will be three inches from the edge of the mattress support or box spring. The retaining strip 25 is then positioned over the mattress support 13 (which is generally a box spring) with the skirt portion 15 extending down from the top of the support 13 over the legs 11 of the bed with the fastening strip 27 of loop forming elements positioned to mate with the hooks on the fastening strip 29.

In order to attain the desired appearance for the bed skirt, it is preferred that the seam between the retaining strip 25 and the skirt portion 15 be arranged at the edge of the mattress support so that the skirt portion 15 may drape in an esthetic way over the bedstead.

At the corners of the bed the excess material is folded over to lie flat as shown in the drawing.

It is thus seen that a simple relatively inexpensive bed skirt has been provided which may readily be fabricated and shipped in a relatively small volume package and installed on a bedstead.

The above disclosure has been given by way of illustration and elucidation and not by way of limitation, and it is desired to protect all embodiments of the herein disclosed invention within the scope of the appended claims.

What is claimed is:

1. A bed skirt for use over the lower part of a bed having a foot and opposed spaced sides and a horizontally extending mattress supported on a mattress support on a bedstead formed by a frame and leg structure, said bed skirt extending over the legs of the bedstead to provide a desired enclosure for the lower portion of the bed to minimize dust accumulations under the bed and to provide a decorative enclosure for the lower part of the bed, said bed skirt comprising:

a vertically extending skirt portion dimensioned to extend along at least the foot and opposed sides of the bed from a point close to the floor to a point above the legs of the bed;

a retaining element extending horizontally from the upper edge of said skirt portion over only the edge of the mattress support (at least a part of the bed frame);

one of a set of complementary fastening elements of a hook and loop type of fastening element secured to said retaining element;

and mating complementary fastening elements of said hook and loop (eye) type of fastening elements adhesively securable to a horizontal surface of the mattress support (bed frame) at points such that the positioning of said fastening elements on the horizontal surface of the mattress support (bed frame) matches the hook and loop fastening elements secured to said retaining element, whereby said retaining element and its associated skirt may be selectively positioned along the side and bottom edges of the bed and held in this selected position.

2. A bed skirt as in claim 1 in which said retaining element comprises a plurality of elongate retaining strips dimensioned to extend the length of the foot and opposed sides of the bed.

3. A bed skirt as in claim 2 in which said retaining strips are of a width of one half to twenty inches.

4. A bed skirt as in claim 2 in which said retaining strips are of a width of three inches.

5. A bed skirt as in claim 1 in which the hook bearing fastening elements are secured to the mattress support and the loop bearing element are secured to said retaining elements.

6. A bed skirt as in claim 1 in which said fastening elements strips are one inch wide.

7. A bed skirt as in claim 2 in which said retaining strip is secured to said skirt portion of said bed skirt by a single continuous line of stitching.

8. A bed skirt for use over the lower part of a bed having a foot and opposed spaced sides and a horizontally extending mattress supported on a mattress support on a bedstead formed by a frame and leg structure, said bed skirt extending over the legs of the bedstead to provide a desired enclosure for the lower portion of the bed to minimize dust accumulations under the bed and to provide a decorative enclosure for the lower part of the bed, said bed skirt comprising:

a vertically extending skirt portion dimensioned to extend along at least the foot and opposed sides of the bed from a point close to the floor to a point above the legs of the bed;

a retaining strip extending horizontally from the upper edge of said skirt portion over only (at least) a part of the mattress support (bed frame), said retaining strip having a (of) a width of three inches;

one of the complementary fastening elements of a hook and loop type of fastening element secured to said retaining strip;

and mating complementary hook and loop fastening elements adhesively securable to a horizontal surface of the mattress support at points such that the spacing of said fastening elements on the horizontal surface of the bed frame matches the spacing of the hook and loop elements secured to said retaining strip, whereby said retaining strip and its associated skirt portion may be selectively positioned along the side and bottom edges of the bed and held in this selected position.

9. A bed skirt as in claim 7 in which said retaining strip is joined to said skirt portion by a seam formed by single pass through a sewing machine.

* * * * *